US008285163B2

(12) United States Patent
Shumiya et al.

(10) Patent No.: US 8,285,163 B2
(45) Date of Patent: Oct. 9, 2012

(54) HIGH-VOLTAGE POWER SUPPLY FOR AN IMAGE FORMING DEVICE

(75) Inventors: Kazushi Shumiya, Konan (JP); Katsumi Inukai, Iwakura (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 274 days.

(21) Appl. No.: 12/726,622

(22) Filed: Mar. 18, 2010

(65) Prior Publication Data

US 2010/0239291 A1 Sep. 23, 2010

(30) Foreign Application Priority Data

Mar. 19, 2009 (JP) ..... 2009-068541

(51) Int. Cl.
*G03G 15/06* (2006.01)

(52) U.S. Cl. ..... 399/55

(58) Field of Classification Search ..... 399/38, 399/53–56, 75, 88, 89, 265, 270
See application file for complete search history.

(56) References Cited

U.S. PATENT DOCUMENTS

| | | | | |
|---|---|---|---|---|
| 4,607,954 | A * | 8/1986 | Osaka et al. | 399/55 |
| 5,864,731 | A * | 1/1999 | Ikemoto et al. | 399/27 |
| 2007/0092270 | A1 | 4/2007 | Inukai | |

FOREIGN PATENT DOCUMENTS

| | | | |
|---|---|---|---|
| JP | 9-325538 | A | 12/1997 |
| JP | 2005-024884 | A | 1/2005 |
| JP | 2005-039477 | A | 2/2005 |
| JP | A-2007-121551 | | 5/2007 |
| JP | A-2008-040090 | | 2/2008 |
| JP | 2008-191529 | A | 8/2008 |

OTHER PUBLICATIONS

Notification of Reasons for Rejection mailed Jan. 11, 2011 in corresponding JP Patent Application No. 2009-068541 together with English-language translation.

Decision of Patent Grant dated May 31, 2011 received from the Japanese Patent Office from related Japanese Application No. 2009-068541, together with an English-language translation.

* cited by examiner

*Primary Examiner* — Hoan Tran

(74) *Attorney, Agent, or Firm* — Scully, Scott, Murphy & Presser, PC

(57) ABSTRACT

A high-voltage power supply for applying a developing bias to a developing roller of an image forming apparatus is provided. The high-voltage power supply includes: a developing bias application unit that applies a developing bias to the developing roller in accordance with a control voltage that is input therein; a developing bias detection unit that detects the developing bias applied to the developing roller; a control voltage adjustment unit that adjusts the control voltage input to the developing bias application unit such that the developing bias detected by the developing bias detection unit approaches a predetermined target value; and a condensation determination unit that determines condensation of the developing bias application unit based on the control voltage.

7 Claims, 3 Drawing Sheets

HIGH-VOLTAGE POWER SUPPLY FOR AN IMAGE FORMING DEVICE

CROSS REFERENCE TO RELATED APPLICATION

The present application claims priority from Japanese Patent Application No. 2009-068541, which was filed on Mar. 19, 2009, the disclosure of which is herein incorporated by reference in its entirety.

TECHNICAL FIELD

Apparatuses and devices consistent with the present invention relate to a high-voltage power supply for applying a developing bias to a developing roller of an image forming apparatus, and in particular, to a high-voltage power supply for detecting a developing bias applied to a developing roller and adjusting a control voltage such that the developing bias approaches a predetermined target value.

BACKGROUND

An image forming apparatus, which is configured to form an image by an electro-photographic method, has a high-voltage power supply for applying a predetermined bias to respective sections. For example, when the high-voltage power supply applies a bias to a charging roller or a transfer roller, a bias voltage is controlled such that a current flowing in the charging roller or the transfer roller becomes constant.

A related art high-voltage power supply is configured to, when the bias voltage of the charging roller or the transfer roller rapidly decreases in a short time, determine that dew condensation occurs and impedance of the charging roller or the transfer roller decreases.

SUMMARY

However, although the related art high-voltage power supply can detect dew condensation occurred in the charging roller or the transfer roller, but it may be impossible to detect dew condensation occurred in the high-voltage power supply itself. For example, according to the related art, it may be impossible to detect dew condensation occurred on a substrate that is one of the components of the high-voltage power supply. Accordingly, it is an object of the invention to provide a high-voltage power supply for applying a developing bias to a developing roller of an image forming apparatus capable of detecting dew condensation occurred in the high-voltage power supply.

According to an illustrative aspect of the present invention, there is provided a high-voltage power supply for applying a developing bias to a developing roller of an image forming apparatus, the high-voltage power supply comprising: a developing bias application unit that applies a developing bias to the developing roller in accordance with a control voltage that is input therein; a developing bias detection unit that detects the developing bias applied to the developing roller; a control voltage adjustment unit that adjusts the control voltage input to the developing bias application unit such that the developing bias detected by the developing bias detection unit approaches a predetermined target value; and a condensation determination unit that determines condensation of the developing bias application unit based on the control voltage.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION (Configuration of High-Voltage Power Supply)

Figure 1:
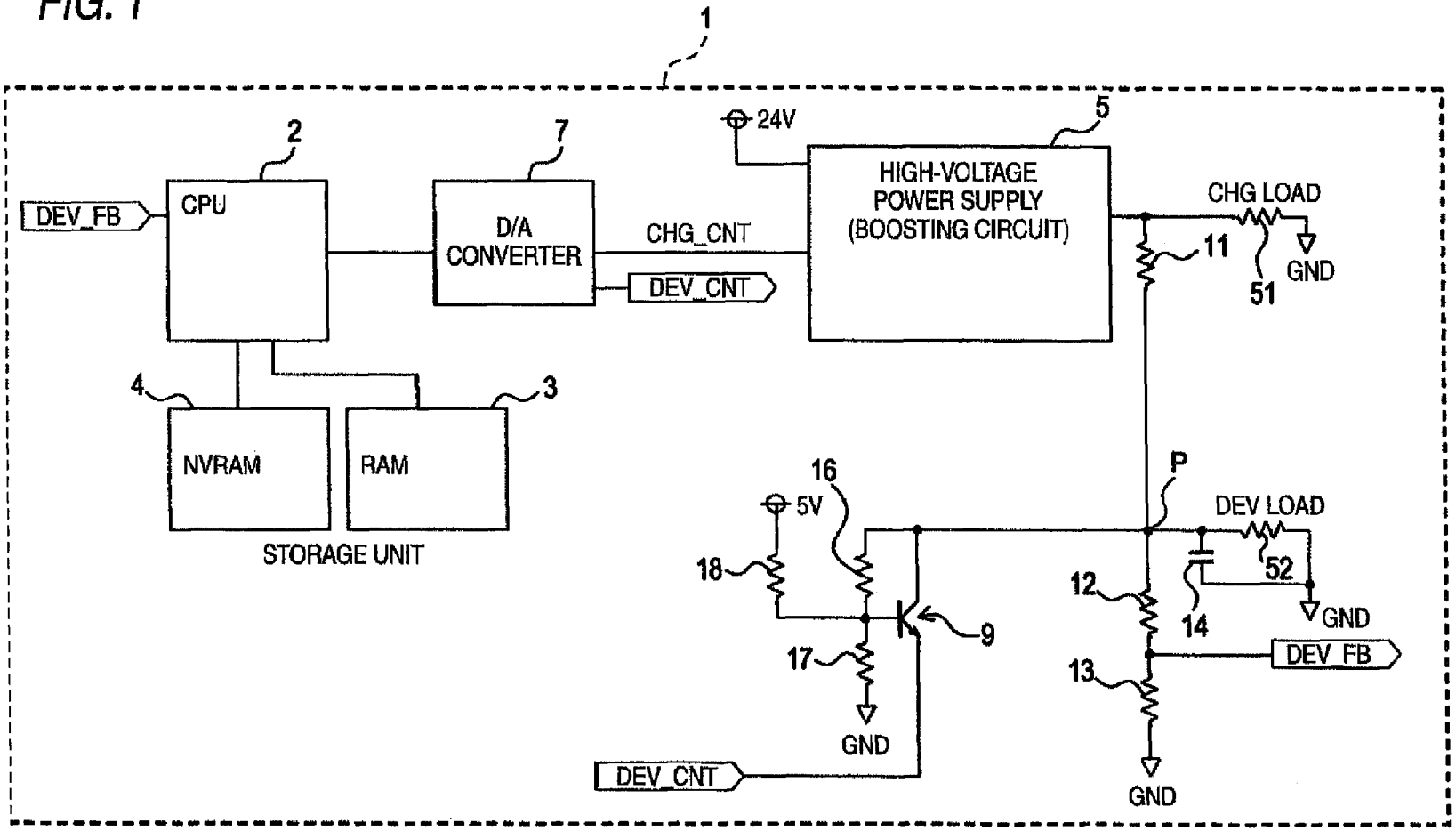
FIG. 1 is an explanatory view showing the configuration of a high-voltage power supply.

An embodiment of the invention will be described with reference to the drawings. FIG. 1 is an explanatory view showing the configuration of a high-voltage power supply 1. As shown in FIG. 1, the high-voltage power supply 1 of this embodiment applies a charging bias to a charger (hereinafter, referred to as a CHG load) 51 of an image forming apparatus, and applies a developing bias to a developing roller (hereinafter, referred to as a DEV load) 52 of an image forming apparatus for forming an image by an electro-photographic method. The CHG load 51 and the DEV load 52 are provided outside the high-voltage power supply 1, but in FIG. 1, for convenience, they are described as symbols of resistors in the frame of the high-voltage power supply 1.

As shown in FIG. 1, the high-voltage power supply 1 includes a control system in which a CPU 2 as an example of a control voltage adjustment unit and a condensation determination unit is connected to a RAM 3 and a NVRAM 4 as an example of a control voltage storage unit, and a boosting circuit 5 which boosts a direct-current voltage of 24 V to generate a charging bias, which is applied to the CHG load 51. A digital signal output from the CPU 2 is input as an analog signal to the boosting circuit 5 or the like through a D/A converter 7.

For example, when a predetermined digital signal output from the CPU 2 is input as an analog control voltage CHG_CNT to the boosting circuit 5 through the D/A converter 7, in the boosting circuit 5, a primary-side energization timing of an internal transformer (not shown) is adjusted in response to the control voltage CHG_CNT, and a charging bias which is applied to the secondary-side CHG load 51 is controlled to a predetermined voltage (for example, 7 kV). Another digital signal output from the CPU 2 is converted into an analog control voltage DEV_CNT by the D/A converter 7 and input to the emitter of a transistor 9 (an example of a developing bias application unit) described below.

An output terminal of the boosting circuit 5 through which the charging bias is output is grounded through resistors 11, 12, and 13, and a voltage at a point P between the resistor 11 and the resistor 12 is applied as a developing bias to a parallel circuit having the DEV load 52 and a capacitor 14. The voltage at the point P is also applied to the collector of the transistor 9. The collector and the base of the transistor 9 are connected to each other through a resistor 16, and the base of the transistor 9 is grounded through a resistor 17 and connected to a direct-current power supply of 5 V through a resistor 18. Therefore, if the control voltage DEV_CNT is increased to limit a current flowing between the collector and the emitter of the transistor 9, the potential at the point P, that is, the developing bias increases.

A potential between the resistor 12 and the resistor 13 as an example of a developing bias detection unit is input as a feedback potential DEV_FB to the CPU 2. The CPU 2 executes a high-voltage control processing (not shown) to adjust the control voltage DEV_CNT in response to the feedback potential DEV_FB such that the developing bias approaches a predetermined target value (for example, 400 V).

Figure 2:
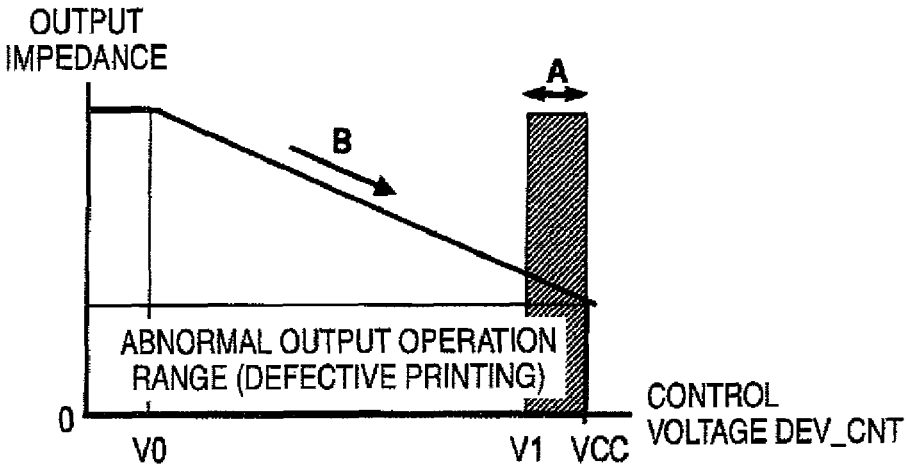
FIG. 2 is an explanatory view showing the relationship between output impedance relative to a DEV load and a control voltage when an output voltage of the high-voltage power supply is controlled constant.

Therefore, as shown in FIG. 2, as output impedance of a circuit relative to application of the developing bias decreases, the control voltage DEV_CNT is controlled to have a high value. The control voltage DEV_CNT does not exceed a power supply voltage VCC (in the foregoing example, 5 V) and does not fall below an upper limit V0 (for example, 0.7 V) of an inactive area depending on the characteristics of the transistor 9. In a normal state where no condensation or the like occurs in the high-voltage power supply 1, the control voltage DEV_CNT is adjusted in a range of V0 to V1 (for example, 4.8 V) shown in FIG. 2.

If condensation occurs in the high-voltage power supply 1 and output impedance decreases, the control voltage DEV_CNT may exceed V1. For example, if a leak current flows between the collector and the emitter of the transistor 9 due to condensation or if a leak current flows between the terminals of the capacitor 14 due to condensation, the output impedance decreases. Accordingly, in this embodiment, a voltage range A of V1 to VCC is stored in the NVRAM 4 as a predetermined range for condensation determination. If condensation occurs in the high-voltage power supply 1 and output impedance abnormally decreases, the amount of change (increase width) of the control voltage DEV_CNT in a predetermined time (for example, 100 seconds) abnormally increases. Accordingly, in this embodiment, when no condensation occurs, the amount of change that cannot occur in the predetermined time is stored in the NVRAM 4 as a predetermined value B.

Figure 3A:
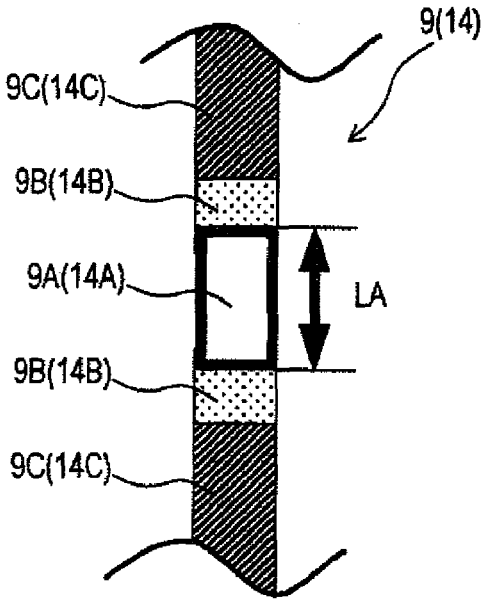
FIGS. 3A and 3B are explanatory views showing foot patterns of components constituting the high-voltage power supply.
Figure 3B:
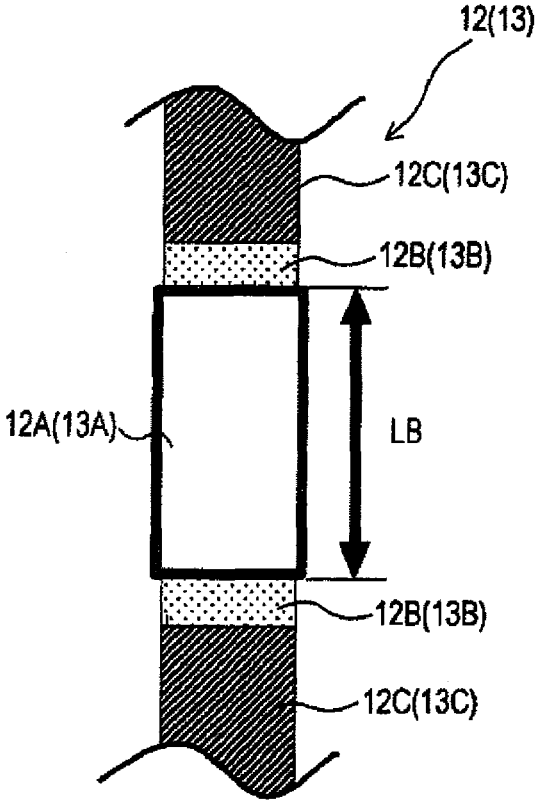

If the resistors 12 and 13 for detecting the feedback potential DEV_FB are condensed rather than the transistor 9 or the capacitor 14 affecting output impedance, condensation determination cannot be accurately performed. Accordingly, in this embodiment, as shown in FIGS. 3A and 3B, a spacing LA of exposed foot patterns 9B or 14B on the surface of a substrate from the periphery of a chip component 9A or 14A constituting the transistor 9 or the capacitor 14 is smaller than a spacing LB of exposed foot patterns 12B or 13B on the surface of a substrate from the periphery of a chip component 12A or 13A constituting the resistor 12 or 13. In FIGS. 3A and 3B, reference numerals 9C, 14C, 12C, and 13C denote portions of the foot patterns 9B, 14B, 12B, and 13B covered with resist.

Therefore, when condensation occurs in the high-voltage power supply 1, condensation affects the transistor 9 and the capacitor 14 rather than the resistors 12 and 13, so a decrease in output impedance can be satisfactorily detected. The chip components 9A, 14A, 12A, and 13A correspond to an example of an electric circuit, and the foot patterns 9B, 14B, 12B, and 13B correspond to an example of conductive portions.

(Processing and Advantages in High-Voltage Power Supply)

Figure 4:
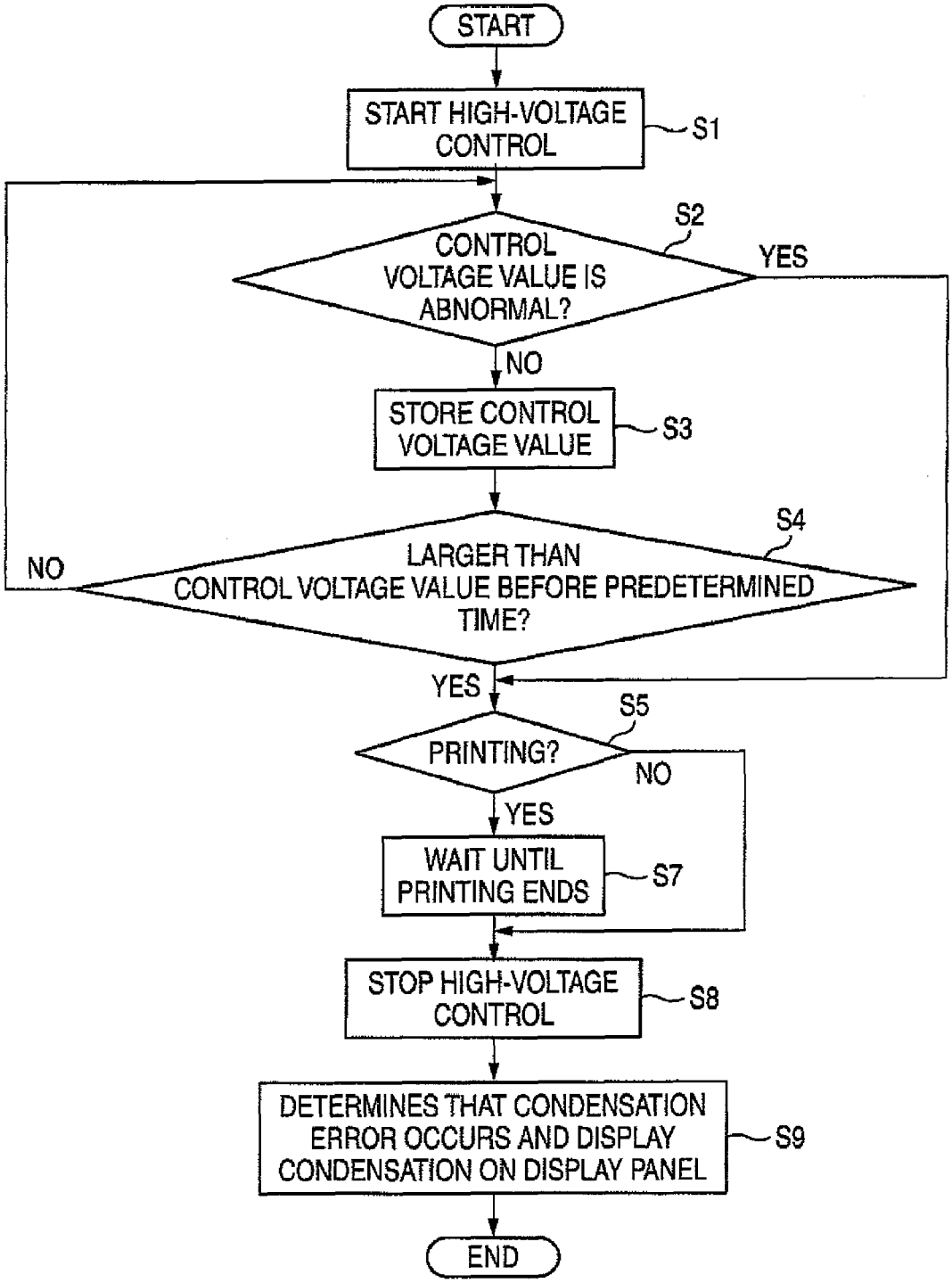
FIG. 4 is a flowchart showing condensation determination processing executed by the high-voltage power supply.

Next, condensation determination processing that is executed by the CPU 2 on the basis of a program stored in an internal ROM of the CPU 2 will be described. FIG. 4 is a flowchart showing the condensation determination processing. This processing starts when the image forming apparatus is powered on.

As shown in FIG. 4, during this processing, in S1 (S represents Step: the same is applied hereinafter), the start of high-voltage control processing by a different routine is instructed. The high-voltage control processing is processing for adjusting the control voltage DEV_CNT in response to the feedback potential DEV_FB such that the developing bias approaches a predetermined target value, as described above.

Next, in S2, it is determined whether the value of the control voltage DEV_CNT which is adjusted by the high-voltage control processing is an abnormal value which falls within the above-described range A (see FIG. 2). When the value of the control voltage DEV_CNT is normal (S2: N), the process progresses to S3, and the value of the control voltage DEV_CNT at that time is stored in the RAM 3. Next, in S4, the control voltage DEV_CNT is compared with the control voltage DEV_CNT stored in the RAM 3 in S3 before the predetermined time, and it is determined whether or not the control voltage DEV_CNT is greater than the predetermined value B (see FIG. 2). When it is determined that the control voltage DEV_CNT is not greater than the predetermined value B through comparison of the control voltage DEV_CNT with the control voltage DEV_CNT before the predetermined time (S4: N), the process progresses to S2 described above. When the value of the control voltage DEV_CNT before the predetermined time is not stored in the RAM 3 immediately after the processing starts, it is determined that the control voltage DEV_CNT is not greater than the predetermined value B (S4: N), and the process progresses to S2.

When no condensation occurs in the high-voltage power supply 1, usually, S2 to S4 are repeatedly executed. Then, the developing bias is controlled to the target value by the above-described high-voltage control processing during that period, printing (image formation) by the image forming apparatus is executed as required. Meanwhile, when power is supplied and external air or heat of the fixing device is circulated in the housing in a state where the housing of the image forming apparatus is cooled, condensation may occur in the circuit constituting the high-voltage power supply 1. When this happens, output impedance abnormally decreases, and the control voltage DEV_CNT has an abnormal value which falls within the range A (S2: Y) or increases by the predetermined value B than the control voltage DEV_CNT before the predetermined time (S4: Y).

In this case (S2: Y or S4: Y), the process progresses to S5, and it is determined whether or not the image forming apparatus is printing. When the image forming apparatus is printing (S5: Y), in S7, it waits until printing ends. When the image forming apparatus is not printing (S5: N), the process progresses to S8. In S8, the above-described high-voltage control processing stops. Next, in S9, it is determined that a condensation error occurs, "condensation" is displayed on the display panel of the image forming apparatus, and the processing ends. Therefore, a user can be notified that condensation occurs before a decrease in the developing bias due to condensation in the high-voltage power supply 1 affects printing quality.

In the above-described processing, S2 and S4 correspond to a condensation determination unit, and the high-voltage control processing corresponds to a control voltage adjustment unit. In S3, the value of the control voltage DEV_CNT may be stored in the NVRAM 4, and in S4, the control voltage DEV_CNT may be compared with the control voltage DEV_CNT stored in the NVRAM 4 before the predetermined time.

As described above, in the high-voltage power supply 1 of this embodiment, the control voltage DEV_CNT falls within the range A that cannot be in the normal state where no condensation or the like occurs in the high-voltage power supply 1 (S2: Y), or the amount of change in the control voltage DEV_CNT has the predetermined value B that cannot be obtained in the predetermined time when no condensation occurs (S4: Y), it can be determined that condensation occurs in the high-voltage power supply 1 (S9). The range A or the predetermined B is set in advance in accordance with the circuit configuration of the high-voltage power supply 1.

Therefore, in this embodiment, it is possible to determine accurately and promptly that condensation occurs in the high-voltage power supply 1, and it is possible to notify the user that condensation occurs before a decrease in the developing bias due to condensation affects printing quality. In this embodiment, the spacing LA between the exposed foot patterns 9B or 14B is smaller than the spacing LB between the exposed foot patterns 12B or 13B. Therefore, while the accurate feedback potential DEV_FB is detected and the control voltage DEV_CNT is adjusted in response to DEV_FB, condensation can be determined. As a result, condensation can be determined more accurately.

The developing roller is used while being filled with toner and not influenced by the number of printed sheets, so the control voltage DEV_CNT is unlikely to be changed by condensation or deterioration of the developing roller. In addition, the DEV load 52 composed of the developing roller has high impedance of, for example, 100 MΩ, and also requires a small amount of current for energization. Therefore, by referring to the control voltage DEV_CNT, it is possible to satisfactorily determine that condensation occurs in the high-voltage power supply 1.

The invention is not limited to the foregoing embodiment, and various modifications may be made without departing from the subject matter of the invention. For example, as the circuit configuration of the high-voltage power supply, various circuit configurations other than that of the embodiment may be adopted. For example, a circuit configuration may be made such that, as output impedance of the circuit relative to application of the developing bias decreases, the control voltage is adjusted to have a small value. Even though the same circuit configuration as that in the embodiment is adopted, the control voltage may abnormally decrease depending on a place where condensation occurs. Accordingly, when the control voltage has an abnormally small value or when a decrease width of the control voltage in a predetermined time is significantly large, it may be determined that condensation occurs.

As described above, according to a first aspect of the present invention, there is provided a high-voltage power supply for applying a developing bias to a developing roller of an image forming apparatus, the high-voltage power supply comprising: a developing bias application unit that applies a developing bias to the developing roller in accordance with a control voltage that is input therein; a developing bias detection unit that detects the developing bias applied to the developing roller; a control voltage adjustment unit that adjusts the control voltage input to the developing bias application unit such that the developing bias detected by the developing bias detection unit approaches a predetermined target value; and a condensation determination unit that determines condensation of the developing bias application unit based on the control voltage.

With this configuration, the developing bias application unit applies the developing bias corresponding to the input control voltage to the developing roller. The developing bias detection unit detects the developing bias applied to the developing roller, and the control voltage adjustment unit adjusts the control voltage such that the developing bias approached the predetermined target value. Therefore, the developing bias can be controlled to the target value. The condensation determination unit determines condensation of the developing bias application unit on the basis of the control voltage adjusted as described above.

That is, if condensation occurs in a circuit constituting the developing bias application unit, the control voltage that is adjusted such that the developing bias approaches the target value may undergo rapid change which cannot occur when no condensation occurs. Accordingly, the condensation determination unit determines condensation of the developing bias application unit on the basis of the control voltage. Further, the developing roller is used while being filled with toner and not influenced by the number of printed sheets, so the control voltage is unlikely to be changed by condensation or deterioration of the developing roller. Therefore, by referring to the control voltage, it can be satisfactorily determined that condensation occurs in the high-voltage power supply.

Further, according to a second aspect of the present invention, in addition to the first aspect, when the control voltage is out of a predetermined range, the condensation determination unit determines that condensation is occurred in the developing bias application unit.

That is, if condensation occurs in the developing bias application unit, the control voltage may have a value that cannot be obtained when no condensation occurs. Accordingly, for example, if the range of the control voltage that can be obtained when no condensation occurs is set to a predetermined range depending on the circuit configuration or the like of the developing bias application unit, the condensation determination unit determines condensation of the developing bias application unit when the control voltage is out of the predetermined range. In this case, it can be determined more accurately that condensation occurs in the high-voltage power supply.

Further, according to a third aspect of the present invention, in addition to the first aspect or the second aspect, the high-voltage power supply further comprises: a control voltage storage unit that stores the control voltage, wherein, when the condensation determination unit determines that, based on the control voltage stored in the control voltage storage unit, an amount of change in the control voltage in a predetermined time is equal to or larger than a predetermined value, the condensation determination unit determines that condensation is occurred in the developing bias application unit.

That is, if condensation occurs in the developing bias application unit, the control voltage may undergo rapid change which cannot occur when no condensation occurs. Accordingly, the amount of change in the control voltage that cannot be obtained in the predetermined time when no condensation occurs is set to a predetermined value in advance in accordance with the circuit configuration or the like of the developing bias application unit, the condensation determination unit determines condensation of the developing bias application unit when the amount of change in the control voltage in the predetermined time is equal to or larger than the predetermined value. In this case, it can be determined more accurately that condensation occurs in the high-voltage power supply. Further, condensation can be determined before the control voltage is out of the predetermined range.

Further, according to a fourth aspect of the present invention, in addition to any one of the first aspect to the third aspect, a spacing between exposed conductive portions on a surface of a substrate of an electric circuit constituting the developing bias application unit is smaller than a spacing between exposed conductive portions on a surface of a substrate of an electric circuit constituting the developing bias detection unit.

Condensation affects the electric circuit due to a leak current caused by condensation between the conductive portions. However, when the spacing between the conductive portions is set as described above, condensation affects the developing bias application unit before condensation affects the developing bias detection unit. Therefore, while the accurate developing bias is detected and the control voltage corresponding to the developing bias is adjusted, condensation of the developing bias application unit can be determined, and thus condensation of the developing bias application unit can be determined more accurately. The electric circuit constituting the developing bias application unit and the electric circuit constituting the developing bias detection unit may be provided on the same substrate or may be provided on different substrates.

What is claimed is:

1. A high-voltage power supply for applying a developing bias to a developing roller of an image forming apparatus, the high-voltage power supply comprising:

a developing bias application unit that applies a developing bias to the developing roller in accordance with a control voltage that is input therein;

a developing bias detection unit that detects the developing bias applied to the developing roller;

a control voltage adjustment unit that adjusts the control voltage input to the developing bias application unit such that the developing bias detected by the developing bias detection unit approaches a predetermined target value; and a condensation determination unit that determines condensation of the developing bias application unit based on the control voltage.

2. The high-voltage power supply according to claim 1, wherein, when the control voltage is out of a predetermined range, the condensation determination unit determines that condensation is occurred in the developing bias application unit.

3. The high-voltage power supply according to claim 2, further comprising:

a control voltage storage unit that stores the control voltage, wherein, when the condensation determination unit determines that, based on the control voltage stored in the control voltage storage unit, an amount of change in the control voltage in a predetermined time is equal to or larger than a predetermined value, the condensation determination unit determines that condensation is occurred in the developing bias application unit.

4. The high-voltage power supply according to claim 3, further comprising a substrate;

wherein the substrate comprises a first electric circuit constituting the developing bias application unit and a second electric circuit constituting the developing bias detection unit;

wherein a spacing between exposed conductive portions of the first electric circuit on the surface of the substrate is smaller than a spacing between exposed conductive portions of the second electric circuit on the surface of the substrate.

5. The high-voltage power supply according to claim 1, further comprising:

a control voltage storage unit that stores the control voltage, wherein, when the condensation determination unit determines that, based on the control voltage stored in the control voltage storage unit, an amount of change in the control voltage in a predetermined time is equal to or larger than a predetermined value, the condensation determination unit determines that condensation is occurred in the developing bias application unit.

6. The high-voltage power supply according to claim 1, further comprising a substrate;

wherein the substrate comprises a first electric circuit constituting the developing bias application unit and a second electric circuit constituting the developing bias detection unit;

wherein a spacing between exposed conductive portions of the first electric circuit on the surface of the substrate is smaller than a spacing between exposed conductive portions of the second electric circuit on the surface of the substrate.

7. A high-voltage power supply for applying a developing bias to a developing roller of an image forming apparatus, the high-voltage power supply comprising:

a substrate;

a developing bias application circuit that is disposed on the substrate, the developing bias application circuit configured to apply a developing bias to the developing roller in accordance with a control voltage that is input therein;

a developing bias detection circuit that is disposed on the substrate, the developing bias detection circuit configured to detect the developing bias applied to the developing roller;

a control voltage adjustment circuit that is disposed on the substrate, the control voltage adjustment circuit configured to adjust the control voltage input to the developing bias application unit such that the developing bias detected by the developing bias detection unit approaches a predetermined target value; and a condensation determination circuit that is disposed on the substrate, the condensation determination circuit configured to determine that condensation is occurred on the substrate when the control voltage is out of a predetermined range and when a changing rate of the control voltage is larger than a predetermined value.

* * * * *